United States Patent [19]

Fuller

[11] Patent Number: 5,069,871

[45] Date of Patent: Dec. 3, 1991

[54] METHOD OF USING AN AUSTENITIC STEEL ALLOY AS A WEAR PART SUBJECT TO GOUGING ABRASION TYPE METAL LOSS

[75] Inventor: William E. Fuller, Lake Oswego, Oreg.

[73] Assignee: ESCO Corporation, Portland, Oreg.

[21] Appl. No.: 518,082

[22] Filed: May 2, 1990

Related U.S. Application Data

[63] Continuation-in-part of Ser. No. 433,655, Nov. 8, 1989, abandoned, which is a continuation-in-part of Ser. No. 253,629, Oct. 5, 1988, abandoned.

[51] Int. Cl.[5] ..... C22C 38/38; C22C 38/58

[52] U.S. Cl. ..... 420/72; 420/73; 420/74; 420/99; 148/329

[58] Field of Search ..... 148/3, 329; 420/73, 420/72, 74, 99

[56] References Cited

U.S. PATENT DOCUMENTS 4,425,169 1/1984 Subramanyam et al. ..... 420/72

*Primary Examiner*—Deborah Yee

*Attorney, Agent, or Firm*—Tilton, Fallon, Lungmus & Chestnut

[57] ABSTRACT

A method of producing a crusher wear part and the like subject to gouging abrasion type metal loss wherein the part is made of a modified austenitic (Hadfields) manganese steel having an Aluminum/Carbon ratio of 1.0 to 1.7, the casting being heat treated by heating to 2000°–2050° F. followed by a water quench to provide gouging abrasion resistance at least about 10% higher than that of Hadfields.

2 Claims, 1 Drawing Sheet

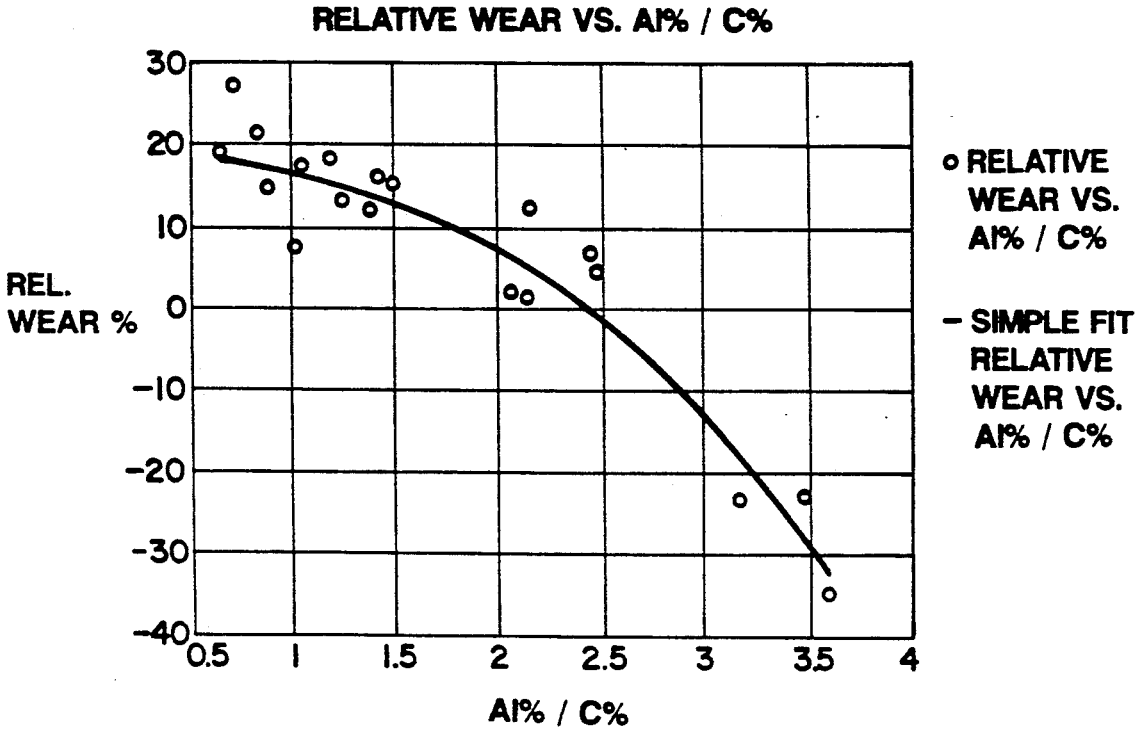
RELATIVE WEAR VS. Al% / C%
30
20
10
0
-10
-20
-30
-40
REL. WEAR %
0.5
1
1.5
2
2.5
3
3.5
4
Al% / C%
o RELATIVE WEAR VS. Al% / C%
– SIMPLE FIT RELATIVE WEAR VS. Al% / C%

METHOD OF USING AN AUSTENITIC STEEL ALLOY AS A WEAR PART SUBJECT TO GOUGING ABRASION TYPE METAL LOSS

This is a continuation-in-part of my copending application Ser. No. 433,655, filed Nov. 5, 1989 which was a continuation-in-part of application Ser. No. 253,629 filed Oct. 5, 1988, now abandoned.

BACKGROUND AND SUMMARY OF INVENTION

This invention relates to a method of producing a crusher wear part and the like subject to gouging abrasion type metal loss and, more particularly, to providing a crusher wear part or the like having a substantially greater wear life than the heretofore used Hadfields manganese steels.

I have determined that it is important for the maximization of wear resistance to balance the carbon and aluminum alloying ingredients in the manganese steel.

A principal deterrent for utilizing aluminum is that its presence in manganese steel can cause considerable problems when the manganese steel is used as scrap in producing other manganese steels. Aluminum is difficult to remove and is an undesirable ingredient of most manganese steels. But on the other hand, it is distinctly advantageous to reprocess the worn crusher parts. Foregoing this reclamation is tolerable if the parts provide a longer wear life—thus justifying the loss of the scrap value.

Aluminum is known as an alloying ingredient in manganese steels but for entirely different purposes and in differing amounts and relationships to carbon than is provided here.

This invention is based on the discovery that the relationship of aluminum to carbon must be carefully regulated in a manganese steel to achieve a wear resistance higher than that of conventional Hadfields steel. More particularly, the aluminum to carbon ratio must be in the range of 1.0 to 1.7 to develop the advantages of the invention. The ranges of alloying ingredients are as follows:

| | |
|---|---|
| Carbon | 1.4–1.8 |
| Manganese | 12–20 |
| Silicon | 0–1.0 |
| Chromium | 0–2.5 |
| Nickel | 0–3 |
| Molybdenum | 0–2 |
| Vanadium | 0–1 |
| Aluminum | 1.5–2.5 |
| Iron | remainder |

Below an Al/C ratio of 1.0, the castings have excessive carbide film in the grain boundaries and can crack prematurely in use while above 1.7 there is no wear advantage to be gained over conventional manganese steels, so the bother with aluminum is not justified.

The prior art has not appreciated the criticality of the Al/C ration, notwithstanding the wealth of art on aluminum-containing steels. The prior art that appears to be closest to the chemistry of the instant invention are U.S. Pat. No. 4,425,169 and Russian Inventor's Certificate 648,647.

The '169 patent was concerned with developing austenitic manganese steel having an as cast perlitic microstructure with several examples of alloys. There is no indication of the criticality of the Al/C ratio and in fact a contra-indication in that one of the preferred modes has a ratio of 0.82. Equally important is the failure of the '169 patent to teach anything about the use of manganese castings as crusher parts and the resistance thereof to gouging type abrasion.

The '647 Certificate also contra-indicates the present invention. Two of the three examples have Al/C ratios well above 2. Further, the sand abrasion tests referred to would not suggest crusher usage. By and large, manganese steel is a totally unacceptable material for low stress wear applications as contemplated in the '647 Certificate.

More particularly, these references fail to suggest the important of testing the melted constituents for the Al/C ratio and, where necessary, adjusting the amounts of constituents to maintain the al/C ratio within the range of 1.0–1.7.

BRIEF DESCRIPTION OF THE DRAWING

The invention is described in conjunction with the accompanying drawing which is a graph showing relative wear resistance of various steel alloys as a function of various aluminum/carbon ratios—more particularly featuring the aluminum/carbon ratios as the abscissa and the wear ratio expressed as percent of relative wear improvement or degradation as compared to the prior art Hadfield steel as the ordinate.

DETAILED DESCRIPTION

As indicated, uses of the alloy can include any and all wear parts that suffer gouging abrasion type metal loss. This includes those found in gyratory crushers as exemplified in co-owned U.S. Pat. No. 4,611,766, jaw crushers as exemplified by co-owned U.S. Pat. No. Re. 25,799, impact crushers as exemplified by co-owned U.S. Pat. No. 3,510,076 and associated materials-handling devices. Parts were made in several heats and were tested in a jaw crusher test facility, the results being tabulated in Table I below. The gouging abrasion testing was according to ASTM G81-83 which is summarized as follows:

ASTM Test

A small laboratory jaw crusher with a feed opening of about 100 by 150 mm (4 by 6 in.) is modified to accept an easily machined identical pair of reference wear plates and a pair of similar test wear plates. One test plate and one reference plate are attached to the stationary jaw frame of the crusher, and the other test and reference plate are attached to the movable jaw frame, such that a reference plate and a test plate oppose one another. The minimum jaw opening is set at 3.2 mm (0.125 in.), and a 225-kg (500-lb) load of prescreened material of suitable hardness is run through the crusher. The minimum opening is then reset to 3.2 mm (0.125 in.) and another 225 kg (500 lb) of rock is crushed. This is repeated until a minimum of 900 kg (2000 lb) of rock is crushed. The precleaned and weighed test plates are then recleaned and weighed, and the mass loss (in grams) is recorded. The volume loss may be calculated from the mass loss and the known densities of the test materials, or it may be measured for nonmonolithic materials. A wear ratio is developed by dividing the volume loss of the test plate by the volume loss of the reference plate. This is done separately for the stationary and the movable plates. The two wear ratios are then averaged for a final test wear ratio. The smaller the decimal figure of the wear ratio the better the wear resistance of the test plate compared to the reference plate. When highly wear resistant test and reference plates are used the total amount of rock must be increased to 1800 kg (4000 lb) or more.

TABLE I

| TEST RESULTS | | | | | |
|---|---|---|---|---|---|
| Heat # | C | Al | Al/C | Wear Ratio | Wear Resistance vs. Hadfields |
| X3065 | 1.65 | 3.40 | 2.06 | .2759 | +1.% |
| X3130 | 1.73 | 3.70 | 2.14 | .2766 | +.6% |
| X3107 | 1.59 | 3.4 | 2.14 | .2476 | +11.3% |
| X3112 | 1.69 | 2.4 | 1.42 | .2363 | +15.3% |
| X3174 | 1.17 | 3.70 | 3.16 | .3460 | −24.0% |
| X3177 | 1.59 | 3.90 | 2.45 | .2625 | +5.9% |
| X3198 | 1.81 | 4.48 | 2.48 | .2691 | +3.5% |
| X3264 | 1.16 | 4.02 | 3.47 | .3441 | −23.3% |
| X3265 | 1.12 | 4.01 | 3.58 | .3777 | −35.4% |
| X3267 | 1.80 | 2.25 | 1.25 | .2430 | +12.9% |
| X3299 | 1.80 | 1.30 | 0.72 | .7271 | +27.3% |
| X3294 | 1.72 | 1.80 | 1.05 | .8339 | +16.6% |
| 00382 | 1.70 | 1.50 | 0.88 | .8540 | +14.6% |
| 00383 | 1.70 | 2.0 | 1.18 | .8214 | +17.9% |
| 00384 | 1.70 | 2.50 | 1.47 | .8542 | +14.6% |
| 00835 | 1.80 | 1.50 | 0.83 | .7896 | +21% |
| 00386 | 1.82 | 2.50 | 1.37 | .8839 | +11.6% |
| | 1.56 | .98 | 0.63 | .8209 | +17.9% |
| | 1.52 | 1.50 | .99 | .9313 | +6.9% |

The fifth column "Wear Ratio" depicts the comparison with two different standards. The first 10 entries were compared to Tl low alloy steels, ASTM A514 at 269 HB hardness. The remaining 9 entries were compared to manganese steel ASTM A128 at 1.15% Carbon. This is conventional Hadfields steel accorded to ASTM A128. Grade B-3 was employed which has the following chemical requirements:

| | |
|---|---|
| Carbon | 1.12–1.28 |
| Manganese | 11.5–14.0 |
| Silicon | 1.0 max. |
| Phosphorous | 0.07 max. |

The chemical analyses of the various heats are set forth in Table II following wherein the balance is iron with normal impurities.

TABLE II

| CHEMICAL ANALYSES | | | | | | | | | | |
|---|---|---|---|---|---|---|---|---|---|---|
| Heat # | C | Mn | Si | Cr | Ni | Mo | Cu | Al | S | P |
| X3065 | 1.65 | 13.10 | .46 | 1.68 | .24 | .26 | — | 3.40 | .007 | .054 |
| X3130 | 1.73 | 12.40 | .77 | 1.38 | — | — | — | 3.70 | .009 | .030 |
| X3107 | 1.59 | 12.96 | .57 | 1.95 | — | — | — | 3.4 | .008 | .028 |
| X3112 | 1.69 | 17.90 | .55 | — | — | — | — | 2.4 | — | — |
| X3174 | 1.17 | 19.20 | .78 | .74 | — | — | — | 3.70 | .011 | .030 |
| X3177 | 1.59 | 13.11 | .72 | .61 | — | — | — | 3.90 | .008 | .028 |
| X3198 | 1.81 | 12.10 | .59 | 1.61 | — | — | — | 4.48 | — | — |
| X3264 | 1.16 | 17.50 | .56 | .63 | — | — | — | 4.02 | — | — |
| X3265 | 1.12 | 18.20 | .66 | .84 | — | — | — | 4.01 | — | — |
| X3267 | 1.80 | 17.20 | .59 | .07 | — | — | — | 2.25 | — | — |
| X3299 | 1.80 | 18.20 | .54 | — | — | — | — | 1.30 | — | — |
| X3294 | 1.72 | 18.20 | .51 | — | — | — | — | 1.80 | — | — |
| 00382 | 1.70 | 14.43 | .53 | .30 | .16 | .29 | | 1.50 | | |
| 00383 | 1.70 | 14.29 | .37 | .30 | .17 | .28 | | 2.0 | | |
| 00384 | 1.70 | 14.06 | .42 | .37 | .18 | .26 | | 2.50 | | |
| 00385 | 1.80 | 13.31 | .32 | .31 | .17 | | | 1.50 | | |
| 00386 | 1.82 | 14.20 | .19 | .21 | .15 | | | 2.50 | | |
| | 1.56 | 17.22 | .63 | .78 | .35 | .26 | | .98 | | |
| | 1.52 | 18.01 | .47 | .27 | .16 | .27 | | 1.50 | | |

Referring again to Table I, it will be seen that the wear ratios are much lower when the inventive samples were compared to T1 steel than when compared to manganese steel. The Tl steel suffered a greater weight loss than the manganese steel—as would be expected with a low alloy steel. Comparing manganese steel to T1 steel gives a wear ratio of 0.279. So when the wear ratios of the test samples are below that, there is an improvement in gouging abrasion type resistance, i.e., less metal loss. In general, I have found that the steels of the invention are 15–20% better than Hadfields. The results of the testing with the two test standards are made comparable in the last column. This column shows what the improvement (+) or degradation (−) was for each test alloy compared to straight Hadfields manganese steel.

Some of the data do not fall into the pattern of the invention at less than an aluminum carbon ratio of about 2 but this probably stemmed from experimental error in the analyses, particularly relative to the aluminum content.

The attached drawing is a chart of the above data using commercially available software. This employs a least square fit using a second order formula derived by the computer program utilizing all of the data.

The Hadfields manganese steels were named after their developer and as a general category they are covered in ASTM A128. Qualitatively, the alloy of the instant invention has much higher manganese content, a higher carbon content plus the addition of aluminum. The aluminum and carbon are balanced for maximum wear resistance and it appears that the interplay of these two elements seems to strongly influence the carbon solubility and therefore the wear resistance.

Other alloying ingredients such as silicon, chromium, nickel, molybdenum, and vanadium can also be added as is conventional in the art.

Other tests were performed against Grade C of ASTM specification A128. This has the following chemical requirements:

| | |
|---|---|
| Carbon | 1.05–1.35 |
| Manganese | 11.5–14.0 |
| Chromium | 1.5–2.5 |
| Silicon | 1.0 max. |
| Phosphorous | 0.07 max. |

Here, the results showed about 10–15% better for the steels of the invention, the Grade C being about 5% better than Hadfields.

The procedure for making the steel alloy involves first melting the ingredients in the furnace. The ingredients may include aluminum if the furnace is an inductance furnace. With an arc furnace, the aluminum is added to the ladle at tap time. In any event, the molten constituents, i.e., the "heat" is then tested for Al/C ratio and corrections made, i.e., the constituent amounts adjusted, to achieve and maintain the Al/C ratio in the 1.0–1.7 range. Preferred foundry practice involves further testing for determination of the Al/C ratio and adjustment, if necessary, particularly after any addition is made.

After determination of the targeted Al/C ratio—normally about 1.4, the heat is poured into molds, cooled and then heat-treated by heating optimally in the range of 2000°–2050° F. followed by water quench.

While in the foregoing specification a detailed description of an embodiment of the invention has been set down for the purpose of explanation, many variations in the details hereingiven may be made by those skilled in the art without departing from the spirit and scope of the invention.

I claim:

1. A method of using an austenitic steel alloy as a wear part subject to gouging abrasion type metal loss, for a crusher comprising:

providing an austenitic steel alloy having an aluminum to carbon ratio of 1.0 to 1.7 based on the following constituents:

| | |
|---|---|
| Carbon | 1.4–1.8% |
| Manganese | 12–20% |
| Aluminum | 1.5–2.5% |
| Silicon | 0–1.0% |
| Chromium | 0–2.5% |
| Nickel | 0–3% |
| Molybdenum | 0–2% |

-continued

| | |
|---|---|
| Vanadium | 0–1% |

with the balance being iron containing normal impurities, melting said constituents and testing the melted constituents for Al/C ratio and adjusting the constituent amounts when the Al/C ratio is outside the range of 1.0 to 1.7 to maintain the melted constituents in the Al/C ratio range of 1.0 to 1.7 to achieve gouging abrasion resistance and to avoid premature cracking due to excessive carbide film in the grain boundries when the said ratio is below 1.0, casting said alloy into a crusher part shape, said shape having wear resistance according to ASTM G81-83 least about 10% higher than that of Hadfields steel, and installing and using said shape in a crusher.

2. The method of claim 1 in which following casting the steps of heating said part to 2000°–2050° F. and water quenching are performed.

* * * * *